US008262242B2

(12) United States Patent
Nishikimi et al.

(10) Patent No.: US 8,262,242 B2
(45) Date of Patent: Sep. 11, 2012

(54) ELECTRIC POWER TOOLS

(75) Inventors: Junichi Nishikimi, Anjo (JP); Kazuo Muramatsu, Anjo (JP); Akira Naito, Anjo (JP)

(73) Assignee: Makita Corporation, Anjo-Shi (JP)

( * ) Notice: Subject to any disclaimer, the term of this patent is extended or adjusted under 35 U.S.C. 154(b) by 200 days.

(21) Appl. No.: 12/796,916

(22) Filed: Jun. 9, 2010

(65) Prior Publication Data

US 2010/0315804 A1 Dec. 16, 2010

(30) Foreign Application Priority Data

Jun. 16, 2009 (JP) ..... 2009-142995

(51) Int. Cl.
*B25B 23/18* (2006.01)

(52) U.S. Cl. ..... 362/119; 408/16

(58) Field of Classification Search ..... 362/119, 362/120; 408/16, 241 R; 81/52
See application file for complete search history.

(56) References Cited

U.S. PATENT DOCUMENTS

| | | | | |
|---|---|---|---|---|
| 7,185,998 | B2 * | 3/2007 | Oomori et al. | 362/119 |
| 2007/0256914 | A1 | 11/2007 | Lohr et al. | |
| 2008/0043459 | A1 * | 2/2008 | Canino et al. | 362/119 |

FOREIGN PATENT DOCUMENTS

| | | | |
|---|---|---|---|
| DE | 10 2004 051 913 | A1 | 2/2006 |
| EP | 1 903 588 | A1 | 3/2008 |
| JP | A 2008-073779 | | 4/2008 |

OTHER PUBLICATIONS

Search Report issued in European Patent Application No. 10006172.0 dated Dec. 27, 2010.

* cited by examiner

*Primary Examiner* — Thomas Sember
(74) *Attorney, Agent, or Firm* — Oliff & Berridge, PLC

(57) ABSTRACT

An electric power tool can include a switch and a lamp that is another member are incorporated in the housing, and the lamp is coupled to the case of the switch and assembled in the grip part integral with the switch.

13 Claims, 6 Drawing Sheets

ELECTRIC POWER TOOLS

This application claims priority to Japanese patent application serial number 2009-142995, the contents of which are incorporated herein by reference.

BACKGROUND OF THE INVENTION

1. Field of the Invention

The present invention relates an electric power tool which is constructed such that a switch and a lamp that is another member are incorporated in a housing of the electric power tool.

2. Description of the Related Art

An existing electric power tool relating to the above invention is described in Japanese Laid-Open patent Publication No. 2008-073779.

A housing of this electric power tool includes a tubular housing part in which a motor and a driving mechanism of the tool are incorporated and a grip part which is formed to protrude downwardly from the tubular housing part. A trigger switch 100 and an illuminating LED are incorporated in the grip part of the housing.

The trigger switch 100 includes a switch main body 102 and a trigger 104 as shown in FIG. 6, and is constructed such that a resistance value of a switch circuit (not shown) is varied in accordance with a pull-and-release operation of the trigger 104. An illumination circuit of the electric power tool is incorporated as well as the switch circuit in a case 102*s* of the trigger switch 100. Lead wires 103*a* and 103*b* for illuminating LED are extended from the case 102*s*, and the LED is connected to the ends of the lead wires 103*a* and 103*b* via a connector 105.

In the above electric motor tool, it is necessary to incorporate the trigger switch 100 and the illuminating LED (not shown) in the grip part of the housing separately, and thus an assembling activity is not good because both members cannot be incorporated at the same time. Further, in order to easily incorporate the trigger switch 100 and the illuminating LED, it is necessary to make the lead wires 103*a* and 103*b* for LED to be long enough. For this reason, a space for placing the excess lead wires 103*a* and 103*b* is required in the grip part after assembling the trigger switch 100 and the illuminating LED in the grip part.

Thus, there is a need in the art to improve an assembling activity of the switch and the lamp in the housing and to make a space for placing the switch and the lamp to be compact.

SUMMARY OF THE INVENTION

One construction for an electric power tool can include a switch and a lamp that is another member are incorporated in a housing of the electric power tool, and characterized in that the lamp is coupled to a case of the switch and can be assembled to the housing together with the switch.

According to this construction the lamp is coupled to the case of the switch and can be assembled to the housing together with the switch. For this reason, the assembling activity can be improved compared with the case where the switch and the lamp are separately assembled in the housing.

Further, when there is a need to connect the switch and the lamp electrically by lead wires, a prior connection of the lead wires can be possible before assembling the switch and the lamp in the housing. For this reason, lead wires having extra length are not required, and a space for placing the switch and the lamp can be compact because a space for placing excess lead wires is not required.

According to another construction, an electric power tool is characterized in that the lamp is releasably coupled to the case of the switch.

For this reason, the switch can be used in both cases where the lamp is required and the lamp is not required in the electric power tools.

According to another construction, an electric power tool is characterized in that the lamp is rotatably coupled to the case of the switch and that a direction of the light from the lamp can be changed.

For this reason, usability of the lamp can be improved

According to another construction, an electric power tool is characterized in that the switch is a trigger switch that can be pulled by an operation of a user's fingertip and that the lamp is arranged below the trigger switch.

According to construction, an electric power tool is characterized in that the housing includes a tubular housing part in which a motor and a driving mechanism of the tool are incorporated and a grip part protruding downwardly from the tubular housing part, and that the switch and the lamp are incorporated in the grip part and the lamp is arranged at a lower part of the grip part.

For this reason, between the top of the tool and the lamp there is no obstacle that may block the light, because the lamp is arranged at the lower part of grip part. Therefore, the area near the top of the tool can be well illuminated by this lamp.

According to another construction, an electric power tool is characterized in that the lamp includes a lens designed such that the light from the lamp can be expanded elliptically.

For this reason, by vertically and elliptically expanding the light from the lamp, the light can be illuminated in a wide range of areas from a near side of the tool to relatively far away from the tool. Further, by horizontally expanding the fight from the lamp, the light can be illuminated widely and horizontally.

According to another construction, an electric power tool is characterized in that the case of the switch includes a holding clip for holding lead wires of the lamp.

For this reason, when the switch and the lamp are assembled in the housing, the lead wires neither move away from the case nor interfere with other parts.

According to the above, an assembling activity of the switch and the lamp in the housing can be improved and a space for placing the switch and the lamp can be made to be compact.

DETAILED DESCRIPTION OF THE INVENTION

Figure 1:
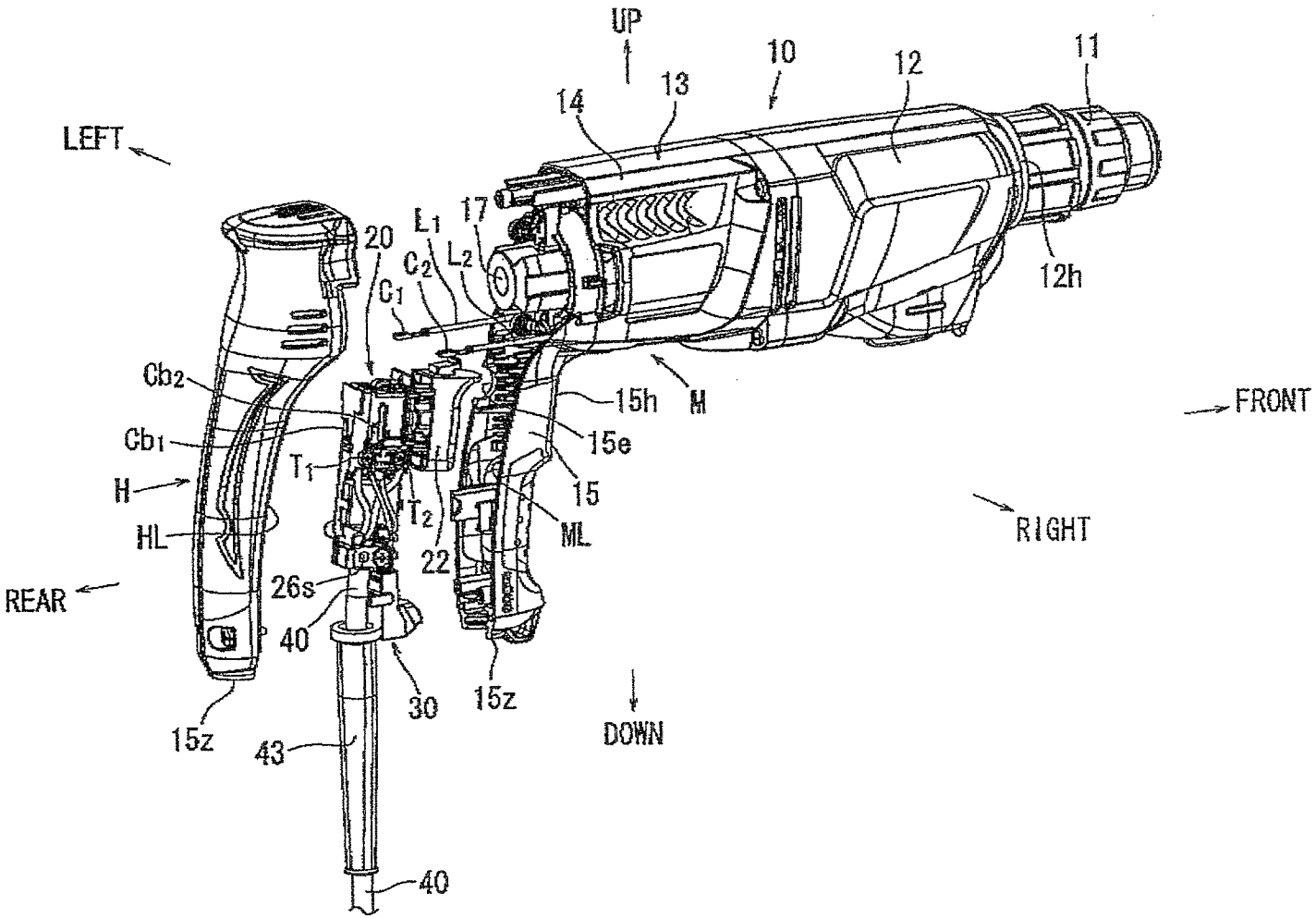
FIG. 1 is an overall perspective view of an electric power tool according to an example in a state in which the grip part is disassembled.
Figure 2:
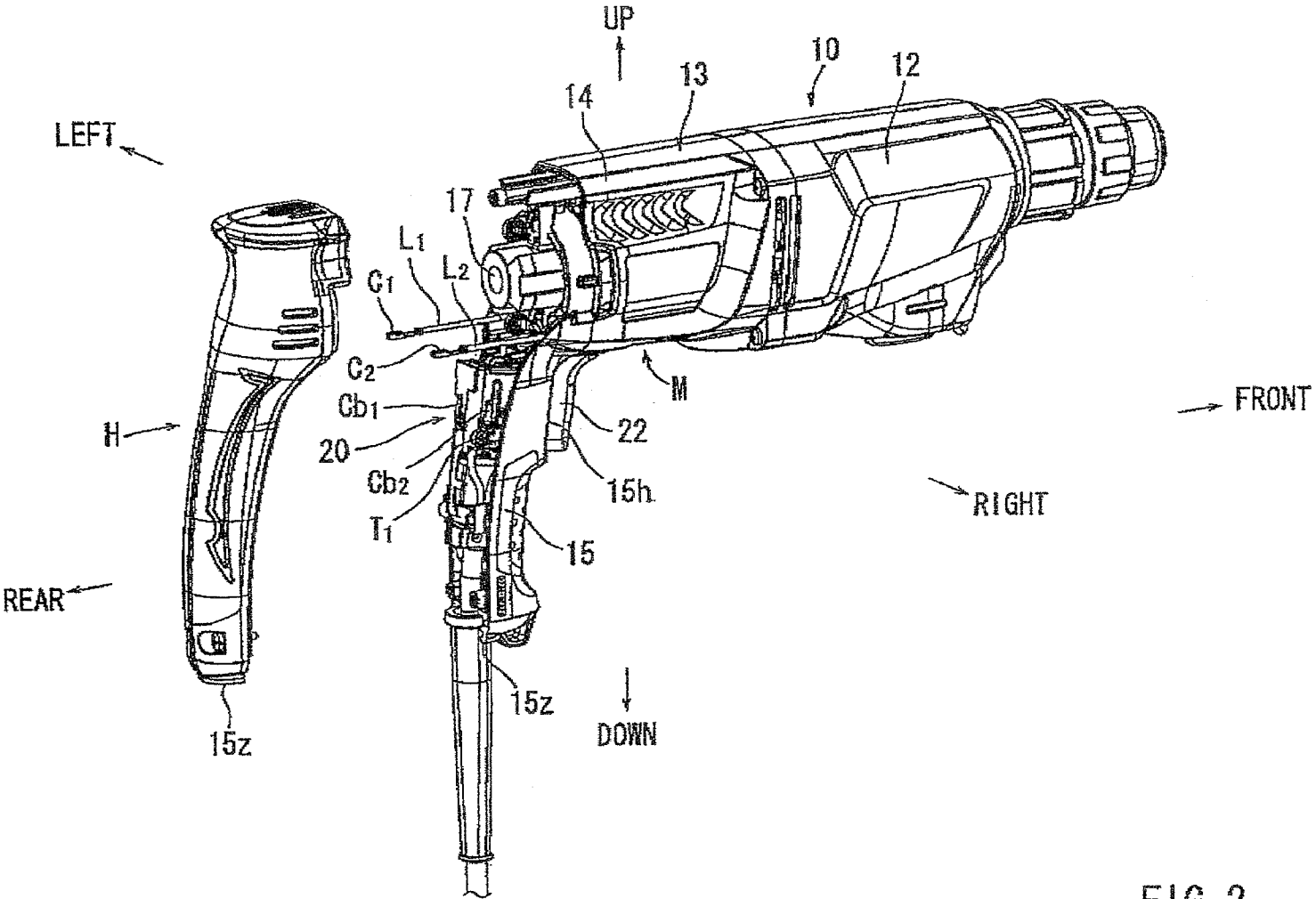
FIG. 2 is an overall perspective view of an electric power tool according to an example in a state in which the grip part is disassembled.

Each of the additional features and teachings disclosed above and below may be utilized separately or in conjunction with other features and teachings to provide improved electric power tools. Representative examples of the present teaching, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

A hammer drill (hereinafter termed an electric power tool) according to an example will be described below with reference to FIG. 1 to FIG. 5.

The front, rear, left, right, up, and down in the figures correspond to the front, rear, left, right, up, and down in an electric power tool.

A housing 10 of the electric power tool of the example includes a tubular front housing 12 and a rear housing 13 which is coaxially coupled to a rear side of the front housing 12. The front housing accommodates a tool driving mechanism (not shown) which rotates a head tool by rotation of a motor 17 (described afterwards). Further, a chuck mechanism 11 that holds the head tool (not shown) is provided in a rotation part (not shown) of the tool driving mechanism that protrudes forward from a head opening section 12*h* of the front housing.

The rear housing 13 includes a housing tube part 14 that is coupled to the front housing 12 and a grip part 15 that is formed to protrude downwardly from a lower surface of the rear of the housing tube part 14. The rear housing 13 is configured to be divided into two parts in a front-back direction. The rear housing 13 includes a housing body part M and a cover part H, and coupling lines ML and HL for coupling the housing body part M and the cover part H are formed in a vertical direction in a rear position of the grip part 15 and the housing tube part 14, respectively.

The housing tube part 14 of the rear housing 13 accommodates a motor 17 as a power source of the electric power tool. Further, the grip part 15 of the rear housing 13 accommodates a trigger switch 20 and an illuminating LED 30.

Figure 3:
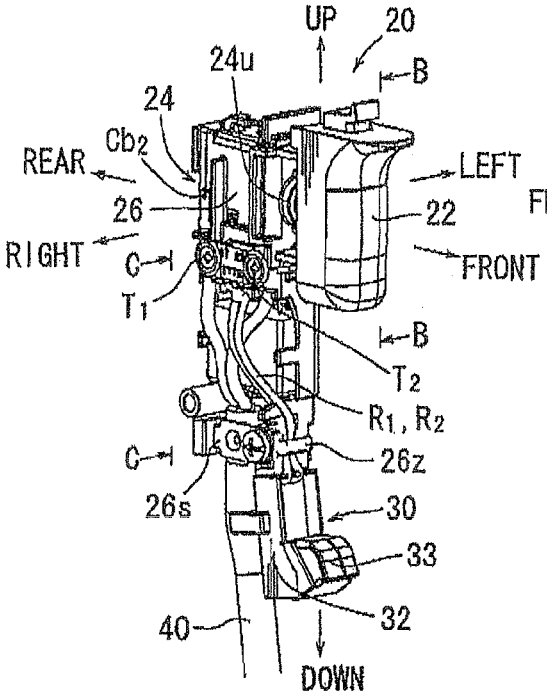
FIG. 3(A) is a perspective view showing a trigger switch and an illuminating LED which are used in the electric power tool.
FIG. 3(B) is a side view showing a trigger switch and an illuminating LED which are used in the electric power tool.
FIG. 3(C) is a side view showing a trigger switch and an illuminating LED which are used in the electric power tool.
FIG. 3(D) is an enlarged view of the D part in FIG. 3(B).
Figure 3:
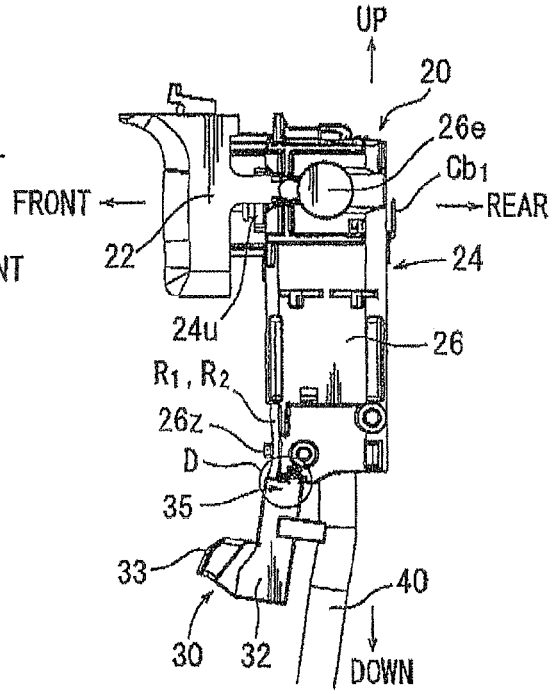
Figure 3:
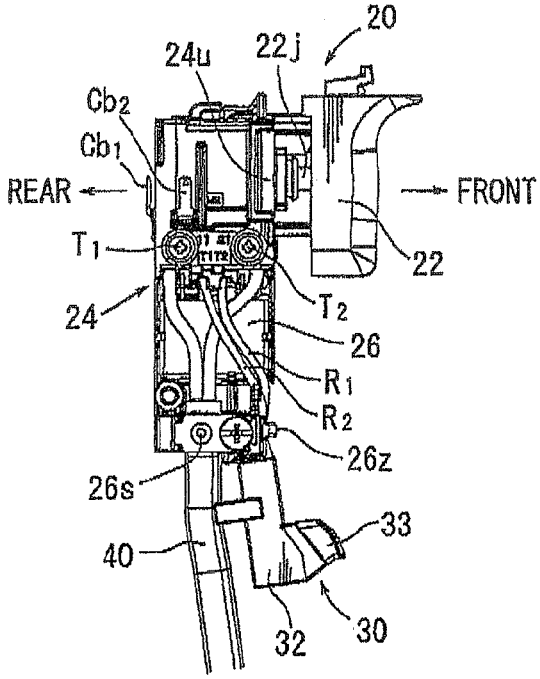
Figure 3:
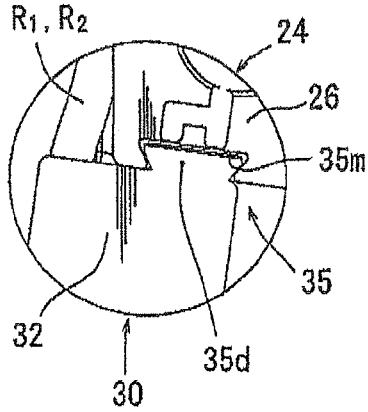
Figure 4A:
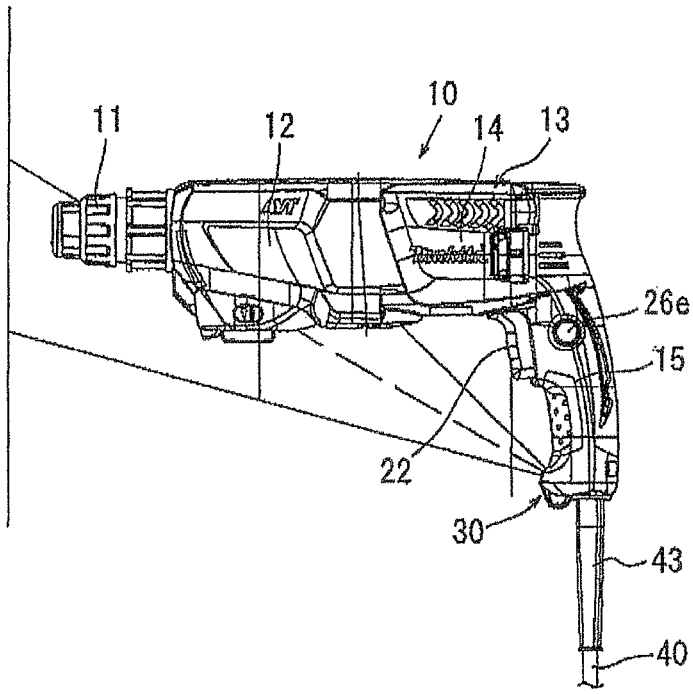
FIG. 4(A) is a side view showing a function of the illuminating LED.
Figure 4B:
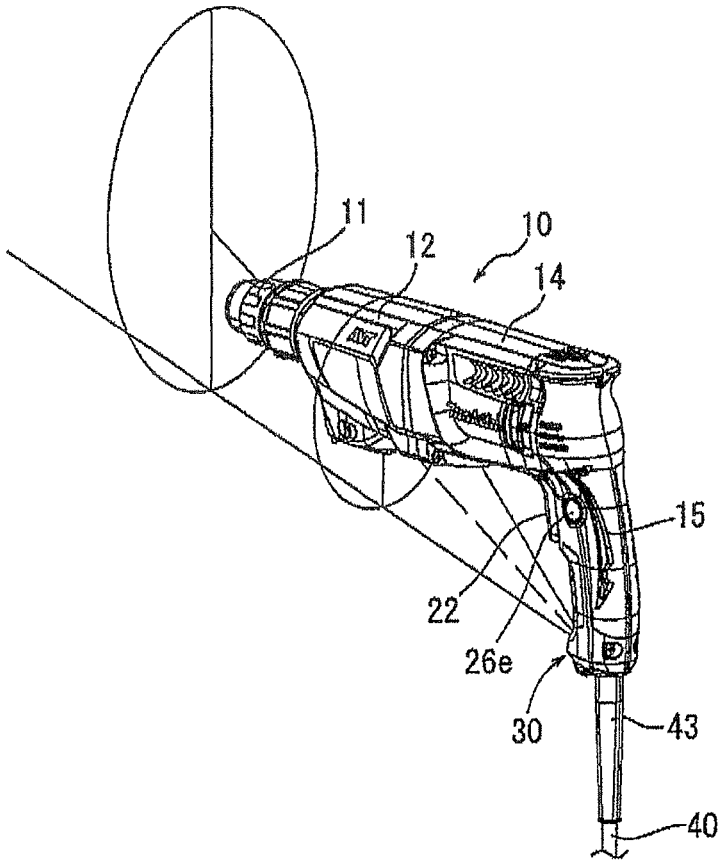
FIG. 4(B) is a perspective view showing a function of the illuminating LED.

The trigger switch 20 is a switch that is pulled by a user with his or her fingertip who holds the grip part 15 of the rear housing 13. As shown in FIG. 3, the trigger switch 20 includes a trigger 22 on which the user can place his or her finger and a switch body 24 to which the trigger 22 is attached.

The switch body 24 includes a receiving part 24*u* at an upper front side of a case 26 of the switch body 24. A column-shaped sliding axis 223 (refer to FIG. 3(C)) protrudes forward from the receiving part 24*u* such that the sliding axis 22*j* can slide forward and backward. The above trigger 22 is attached to a protruding end of the sliding axis 223. Further, a biased spring (not shown) is housed within the case 26 such that the trigger 22 and the sliding axis 22*j* may protrude to a forward end. When the trigger 22 is pulled, the sliding axis 223 can be pushed into the case 26 (move rearward) against the spring force, and when the user releases his or her finger from the trigger 22, the trigger 22 can be returned to its front-end position by the spring force.

A switch circuit (not shown) is housed within the case 26 of the switch body 24 such that a switch contact is turned on and off and the contact resistance varies by a pull-and-release operation of the trigger 22.

Screwed power terminals T1 and T2 to which the ends of a power cable 40 are connected are provided in the center of the right outer side of the case 26 of the switch body 24 as shown in FIG. 3(A) and FIG. 3(C). Further, a cable retaining part 26*s* for retaining the power cable 40 is provided at a lower part of the right outer side of the case 26. The power cable 40 is connected to an AC power supply. Alternatively, the power cable 40 may be connected to a DC power supply, such as a battery cell.

Further, in the right outer surface and the rear outer surface of the case 26, tabular terminals Cb1 and Cb2 to which connecters C1 and C2 of motor cables L1 and L2 (refer to FIG. 1 and FIG. 2) are connected are provided at an upper side of the screwed power terminals T1 and T2 in parallel with the outer surface of the case 26.

Further, a column-shaped positioning protrusion 26*e* is formed at an upper part of the left outer side of the case 26 of the switch body 24 as shown in FIG. 3(B). The protrusion 26*e* can be fitted to a circular concave part 15*e* provided in coupling lines ML and HL for coupling the housing body part M and the cover part H which the rear housing 13 includes.

Further, an illuminating LED 30 is arranged at a front side of the lower part of the case 26 of the switch body 24.

The trigger switch 20 may serve as a switch of the example.

The illuminating LED includes a case 32 the sides of which are formed in a L-shaped way, a lens part 33 which is formed such that a lower end part of the case 32 is blocked by the lens part 33, and a LED (not shown) which is a light source housed in the case 32. An upper part of the case 32 of the illuminating LED is coupled to a front side of a lower part of the case 26 of the switch body 24 by a coupling mechanism 35. The coupling mechanism 35 includes an inverted trapezoid-shaped straight ditch 35*m* which is formed to extend in a horizontal direction at a front side of a lower part of the case 26 of the switch body 24 and an inverted trapezoid-shaped protrusion 35*d* which is formed to extend in a horizontal direction at an upper part of the case 32 of the illuminating LED 30. The case 26 of the switch body 24 can be coupled to the case 32 of the illuminating LED 30 by slidingly fitting the straight ditch 35*m* of the case 26 of the switch body 24 to the protrusion 35*d* of the case 32 of the illuminating LED 30 in a horizontal direction.

By sliding the case 32 of the illuminating LED 30 with respect to the case 26 of the switch body 24, the coupled cases 26 and 32 can be separated.

Lead wires R1 and R2 are extended from the top of the case 32 of the illuminating LED 30. The end of the lead wires R1 and R2 can be connected to terminals (not shown) located between the screwed power terminals T1 and 12, and the lead wires R1 an R2 are connected to an illumination circuit (not shown) in the case 26 via the terminals T1 and T2. The lead wires R1 and R2 are held with a holding clip 26*z* that is formed at a front side of a lower part of the case 26 of the switch body 24, whereby the lead wires R1 and R2 are held along the surface of the case 26.

Further, the lens part 33 of the illuminating LED 30 is designed such that the light from the LED can be expanded vertically and elliptically.

The illuminating LED may serve as a lamp of the example.

To assemble the trigger switch 20 and the illuminating LED 30 into a housing 10 of the power tool, firstly the illuminating LED is coupled to the case 26 of the trigger switch 20 by way of the coupling mechanism 35. Then, the lead wires R1 and R2 of the illuminating LED 30 are connected to the terminals provided in the case 26 of the trigger switch 20, and the lead wires R1 and R2 are held along the surface of the case 26 with the holding clip 26*z*. Further, the end of the power cable 40 is connected to the power terminals T1 and T2 of the case 26 of the trigger switch 20, and the power cable 40 is held to the case 26 of the trigger switch 20 by a cable retaining mechanism 26*s*. In this way, the trigger switch 20, the illuminating LED 30, and the power cable 40 are integrally assembled, as shown in FIG. 3 etc.

In addition, prior to the connection of the lead wires R1 and R2, the ends of the power cable 40 can be previously connected.

Next, the trigger 22 of the trigger switch 20 is passed through a trigger opening section 15*h* formed at an upper part of the grip part 15 in the housing body part M (rear housing 13), and the positioning protrusion 26*e* of the trigger switch 20 is fitted to the circular concave part 15*e* provided in the coupling line ML of the housing body part M. In this way, the illuminating LED 30 integrally assembled to the trigger switch 20 is set to a front side of a lower part of the grip part 15 of the housing body part M, and also a protective tube for the power cable 40 is fitted to a semi-circular tube-receiving part 15*z* formed at a lower end of the grip part 15 of the housing body part M.

Next, the connectors C1 and C2 of the motor cable L1 and L2 are respectively connected to tabular terminals Cb1 and Cb2 famed in the case 26 of the trigger switch 20. In this way, the coupling lines ML and HL of the cover part H are fitted to the housing body part M of the rear housing 13. Then, the cover H is bolted to the housing body part M, and assembling the trigger switch 20 and the illuminating LED 30 is completed.

According to the electric power tool of the example, the electric power tool is configured such that the illuminating LED is coupled to the case of the trigger switch 20 and assembled into the rear housing 13 integral with the trigger switch 20. And thus, compared with the case where the trigger switch 20 and the illuminating LED 30 are separately assembled into the rear housing 13, assembling activity of the example can be improved.

Further, when the lead wires R1 and R2 are electrically connected between the trigger switch 20 and the illuminating LED 30, the lead wires R1 and R2 can be preliminarily connected before the trigger switch 20 and the illuminating LED 30 are assembled into the rear housing 13. And thus, lead wires having extra length are not required, and a space for placing the trigger switch 20 and the illuminating LED 30 can be compact because a space for placing excess lead wires R1 and R2 is not required.

Further, since the illuminating LED is configured to be releasably coupled to the case 26 of the trigger switch 20, the trigger switch 20 can be used in both cases where the illuminating LED is required and the illuminating LED is not required.

Further, between the top of the tool and the illuminating LED 30 there is no obstacle that may block the light, because the illuminating LED 30 is placed at the lower part of the grip part 15 of the rear housing 13. Therefore, the area near the top of the tool can be well illuminated by the illuminating LED.

Further, the illuminating LED 30 includes the lens part 33 constructed such that the light from the illuminating LED 30 can be expanded vertically and elliptically. And thus, by expanding the light from the illuminating LED 30 vertically and elliptically, the light can be illuminated in a wide range of areas from a near side of the tool to relatively far way from the tool.

Further, since the case 26 of the trigger switch 20 includes a holding clip 26*z* for holding the lead wires R1 and R2 of the illuminating LED 30, the lead wires R1 and R2 neither move away from the case 26 nor interfere with other parts when the trigger switch 20 and the illuminating LED 30 are assembled in the rear housing 13.

Figure 5:
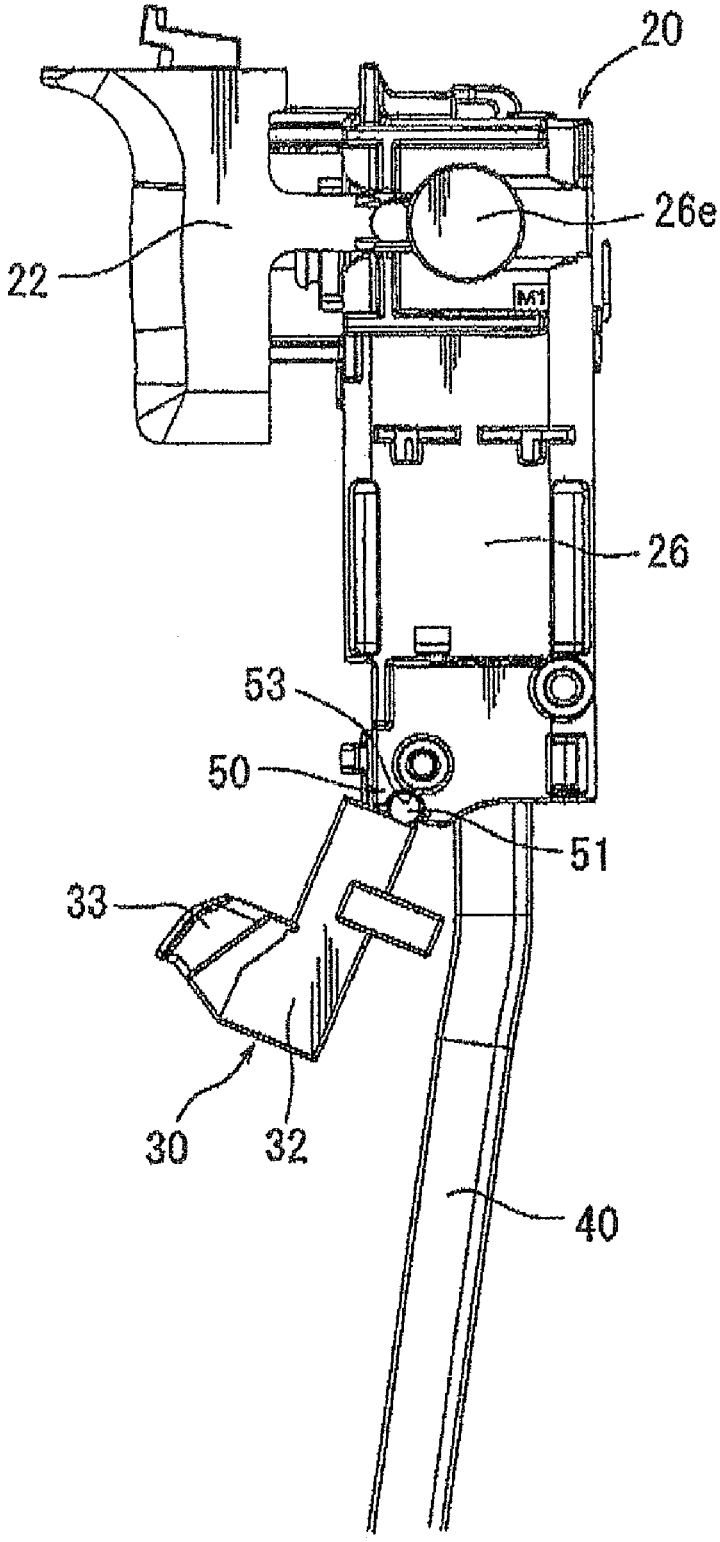
FIG. 5 is a side view showing a trigger switch and an illuminating LED according to a modified example.
Figure 6:
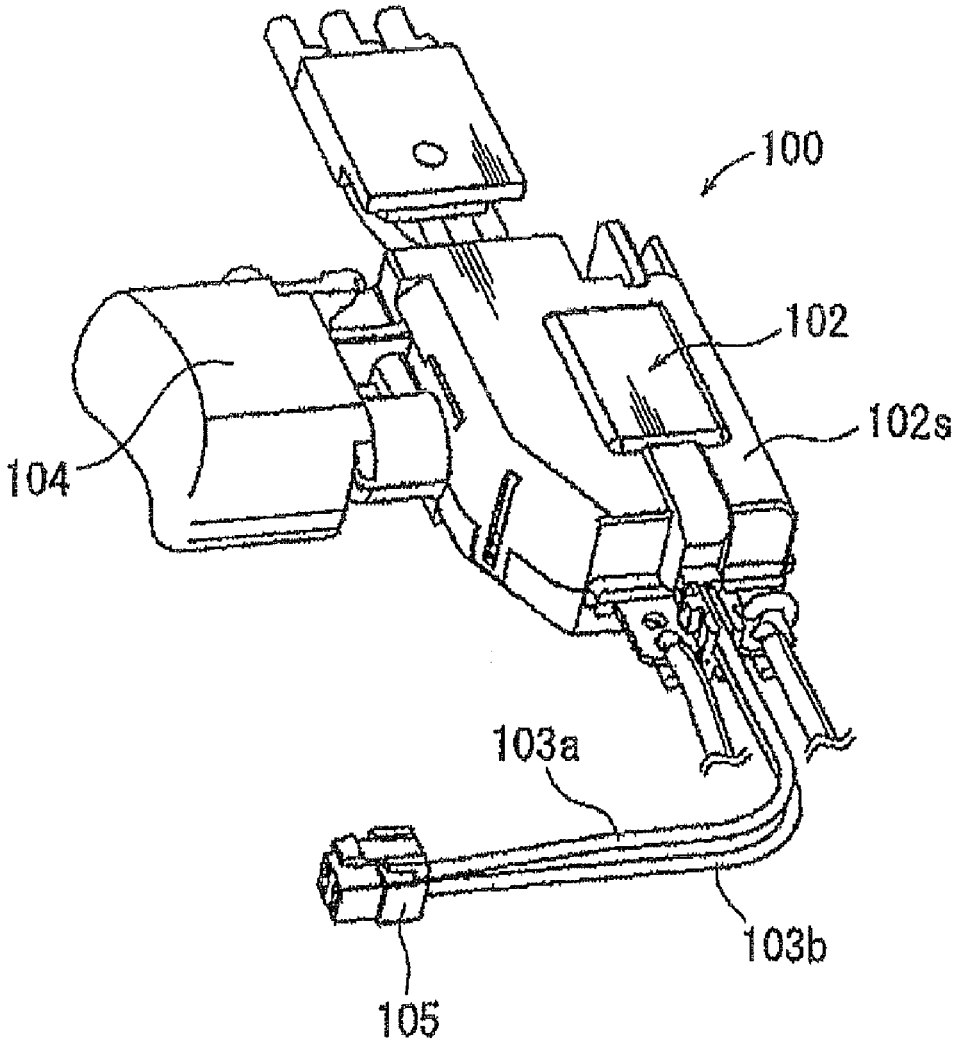
FIG. 6 (PRIOR ART)
FIG. 6 is a perspective view showing a known trigger switch etc.

The above construction may not be limited by the above-described example and various changes may be made without departing from the scope if the invention. For example, the above example shows that the trigger switch 20 and the illuminating LED 30 include the inverted trapezoid-shaped straight ditch 35*m* and the protrusion 35*d* respectively. However, as shown in FIG. 5), it is possible to be constructed such that the illuminating LED is rotatably coupled in a vertical direction to the trigger switch 20 by use of a coupling mechanism 50 which includes a pin 51 and an insertion hole 53. And thus, illuminating direction of the light can be changed and assembling activity of the illuminating LED 30 can be improved.

Further, the above example shows that the light from the illuminating LED 30 is expanded vertically and elliptically by the lens part 33 for the illuminating LED 30, but it is possible to expand the light from the illuminating LED 30 horizontally and elliptically. And thus, the area near the top of the tool can be illuminated in a wide range in a horizontal direction.

Further, the example shows that the trigger switch 20 is used as a switch, but it is possible to be constructed such that the illumination LED 30 can be coupled to another type of switch other than the trigger switch 20, for example a rotary selector switch.

We claim:

1. An electric power tool, comprising a switch and a lamp, the switch and the lamp being incorporated in a housing of the electric power tool, wherein, the lamp is coupled to a case of the switch and assembled to the housing integral with the switch, the lamp is releasably coupled to the case of the switch, and the switch is a trigger switch that can be pulled by a user's fingertip and the lamp is coupled to a lower part of the trigger switch.

2. The electric power tool according to claim 1, wherein the lamp is rotatably coupled to the case of the switch and a direction of the light from the lamp can be changed.

3. The electric power tool according to claim 1, wherein:

the housing includes a housing tube part in which a motor and a tool drive mechanism are accommodated and a grip part that protrudes downwardly from the housing tube part; and the switch and the lamp are incorporated in the grip part, the lamp being disposed at a lower part of the grip part.

4. The electric power tool according claim 3, wherein the lamp includes a lens by which the light from the lamp can be expanded elliptically.

5. The electric power tool according to claim 4, wherein the case of the switch includes a holding clip for holding lead wires of the lamp.

6. The electric power tool according to claim 5, wherein the lamp is an LED.

7. A method for assembling a switch and a lamp with a housing of an electric power tool, comprising the steps of:

providing a case of the switch;

attaching a switch to the case;

coupling a lamp to the case;

inserting the case to the housing, and holding lead wires of the lamp with a holding clip, wherein the lamp is releasably and rotatably coupled to the case, and the holding clip is provided in the case.

8. The method of claim 7, wherein the housing includes a housing tube part and a grip part, and the case is inserted to the grip part.

9. An electric power tool, comprising a switch and a lamp, the switch and the lamp being incorporated in a housing of the electric power tool, wherein, the lamp is coupled to a case of the switch and assembled to the housing integral with the switch, the lamp is releasably coupled to the case of the switch, the lamp is rotatably coupled to the case of the switch and a direction of the light from the lamp can be changed, and the switch is a trigger switch that can be pulled by a user's fingertip and the lamp is coupled to a lower part of the trigger switch.

10. The electric power tool according to claim 9, wherein: the housing includes a housing tube part in which a motor and a tool drive mechanism are accommodated and a grip part that protrudes downwardly from the housing tube part; and the switch and the lamp are incorporated in the grip part, the lamp being disposed at a lower part of the grip part.

11. The electric power tool according claim 10, wherein the lamp includes a lens by which the light from the lamp can be expanded elliptically.

12. The electric power tool according to claim 11, wherein the case of the switch includes a holding clip for holding lead wires of the lamp.

13. The electric power tool according to claim 12, wherein the lamp is an LED.

* * * * *